US006425425B2

(12) United States Patent
Bianchi et al.

(10) Patent No.: US 6,425,425 B2
(45) Date of Patent: Jul. 30, 2002

(54) REFRIGERATED WATER DISPENSER FOR REFRIGERATORS

(75) Inventors: Carlo Bianchi, Seveso; Marco Signa, Arcisate; Marco Maritan, Viggiu', all of (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/755,831

(22) Filed: Jan. 5, 2001

(30) Foreign Application Priority Data

Jan. 27, 2000 (IT) ..... MI00A000108

(51) Int. Cl.[7] ..... B65B 1/04

(52) U.S. Cl. ..... 141/362; 141/82; 141/351; 222/146.6

(58) Field of Search ..... 141/351, 360, 141/361, 362, 98, 82; 222/146.6, 129.1, 181.1–181.3, 185.1; 62/337–339, 389

(56) References Cited

U.S. PATENT DOCUMENTS 3,934,757 A * 1/1976 Malek et al.
4,209,999 A * 7/1980 Falk et al. ..... 141/362
4,651,789 A 3/1987 Linstromberg
5,033,273 A * 7/1991 Buchser et al.
5,526,854 A * 6/1996 Unger
5,542,265 A * 8/1996 Rutland
5,787,724 A 8/1998 Pohl et al.
5,971,213 A 10/1999 Lee

FOREIGN PATENT DOCUMENTS

GB 2246195 1/1992 ..... F25D/23/04

* cited by examiner

*Primary Examiner*—Steven O. Douglas
(74) *Attorney, Agent, or Firm*—Robert O. Rice; Stephen D. Krefman; Joel M. Van Winkle

(57) ABSTRACT

A water dispenser for a refrigerator door having a water delivery port. The dispenser includes a base mounted to the door for forming a compartment enclosing the water delivery port. The base has an aperture for accessing the interior of the compartment and the water delivery port. A cover is pivotably supported by the base and is biased for closing the aperature. The cover pivots inwardly into the e compartment for accessing the water delivery port.

18 Claims, 4 Drawing Sheets

REFRIGERATED WATER DISPENSER FOR REFRIGERATORS

BACKGROUND OF THE INVENTION

1. Field of the Invention

This invention relates to a through-the-door water dispenser for refrigerators.

2. Description of the Related Art

The most developed current domestic refrigerators comprise a system for producing refrigerated water which can be procured without having to gain access to the refrigerator interior. In practice, a connection to the domestic water supply is provided, together with a hydraulic circuit inside the refrigerator (positioned to cool the water passing through it and provided with a delivery port for the refrigerated water) and a valve member operated by the user to obtain the refrigerated water. In these refrigerators it is normal to provide inside the refrigerator door a compartment open towards the refrigerator exterior and containing this delivery port and an underlying support surface for the glass or the like to be filled with the refrigerated water. The compartment is hence of appreciable depth. The electromagnetically controlled delivery valve member is opened by the user, who manually operates an electric switch.

This briefly described solution has certain drawbacks: the door presenting the compartment has to be specially constructed, in the sense that being so different from conventional doors it demands its own production cycle and specific equipment; the presence of the compartment has considerable negative influence on the refrigerator appearance; the glass or container receiving the refrigerated water cannot be greater than a certain size given that for constructional and appearance reasons the compartment itself cannot exceed given dimensions; from the hygiene aspect the known solution can be highly criticized, being open to the air and as such accessible to insects, dust and dirt in general; and, in certain cases, the nuisance of having firstly to place the glass in the compartment and then open the delivery valve.

SUMMARY OF THE INVENTION

An object of this invention is to provide a refrigerated water dispenser which only modestly disturbs the visual impact of the refrigerator, which does not have an insect, dirt and dust accessible compartment in which to place the glass or container, which does not require two operations to deliver the refrigerated water, which does not require substantial production modifications for the door in which the dispenser is installed, which is of simple construction, considerable functionality and ease of operation, and which enables the user to use glasses or containers of any dimensions.

These and other objects are attained by a water dispenser for a refrigerator door having a water delivery port. The dispenser includes a base mounted to the door for forming a compartment enclosing the water delivery port. The base has an aperture for accessing the interior of the compartment and the water delivery port. A cover is pivotably supported by the base and is biased for closing the aperature.

BRIEF DESCRIPTION OF THE DRAWINGS

The invention will be better understood from the detailed description of a preferred embodiment thereof given hereinafter by way of non-limiting example and illustrated in the accompanying drawings, in which.

DESCRIPTION OF THE PREFERRED EMBODIMENT

Figure 1:
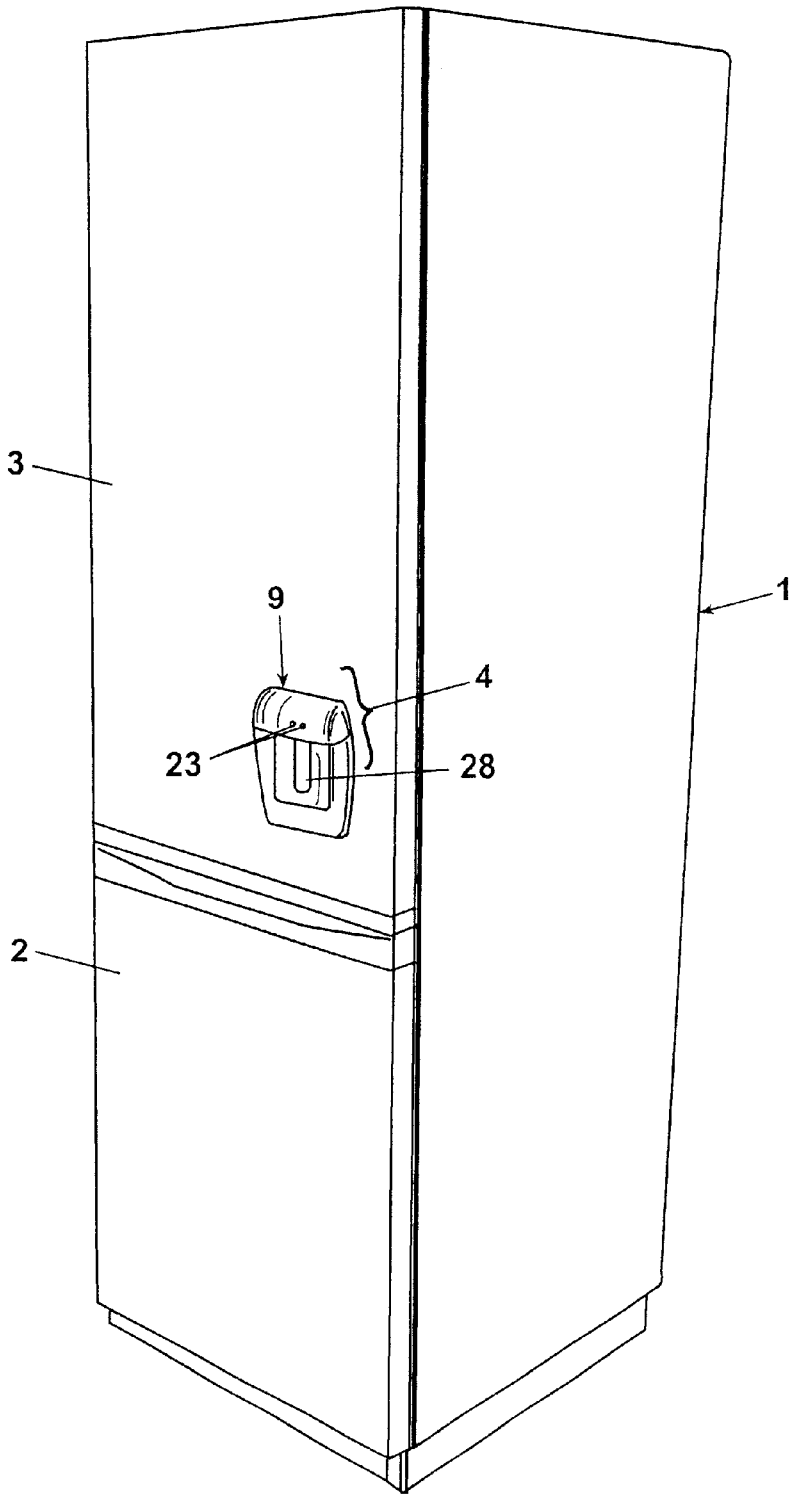
FIG. 1 is a perspective view of a refrigerator provided with the dispenser of the invention.

Before commencing the description it should be noted that the term "dispenser" as used herein identifies that component of a water feed, cooling and delivery system which performs the delivery function.

With reference to the drawings, the reference numeral 1 indicates a refrigerator presenting, in this example, a lower freezer compartment and an upper refrigerating compartment closed by respective double wall doors 2 and 3 with an interspace in which the thermoinsulating material is present.

The dispenser of the invention, indicated overall by 4, is applied against the outer wall 3*a* of the door 3, which can be of conventional type in its general structure.

Figure 3:
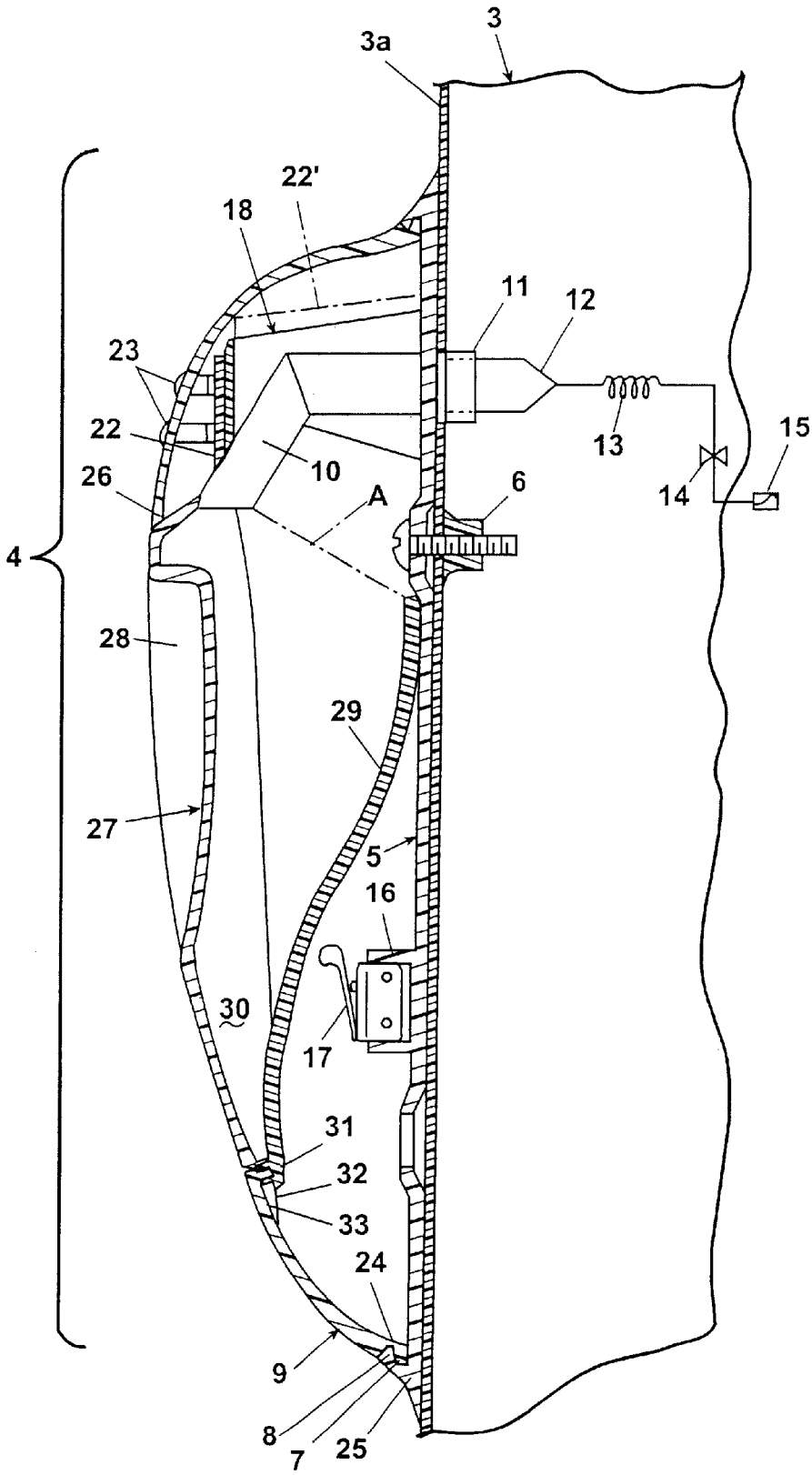
FIG. 3 is a longitudinal section through the dispenser of the invention.
Figure 4:
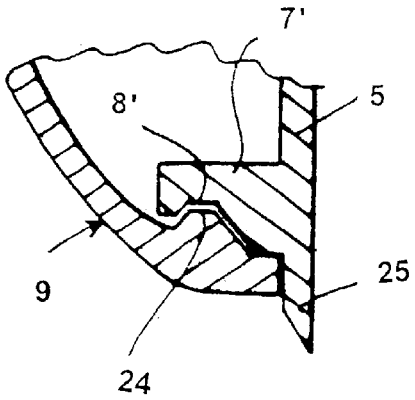
FIG. 4 is a section through a detail relative to the snap-connection of parts of the dispenser, and a particular shaping for adapting to the profile of one of these parts.

The dispenser 4 forms a compartment and comprises a substantially plate-like base 5 preferably of plastic material which is directly applied to the door and fixed by conventional means, for example of screw type, only one of which is shown in FIG. 3 in which it is indicated by 6, or by conventional plastic rivets. The base 5 has a surrounding wall 7 which can for example assume the configuration of FIG. 3 or of FIG. 4. In FIG. 3 the wall has a continuous projection 8 to enable another component of the dispenser to be snap-fitted, this component being described in detail hereinafter and being indicated by 9. In the alternative of FIG. 4 the wall 7' has a recess 8' to enable said component 9 to be snap-fitted. In both solutions the wall 7, 7' is provided peripherally with a flexible flange, rib or end 25, the purpose of which is described hereinafter.

The base 5 presents, preferably integral therewith, a projecting port 10 with a downwardly directed opening, through which the refrigerated water is delivered. Coinciding therewith on the inner side of the base 5, there is a connector 11 which extends for a short distance inwards of the outer wall 3*a* of the door 3, to allow the connection, by conventional means, not shown, of a pipe 12 forming part of the water feed and cooling system (traditional and well known in this sector) comprising, by way of example, a heat exchanger 13, a solenoid valve 14 and a connector 15 for connection to the domestic water supply, and possibly an electrically powered pump.

Figure 6:
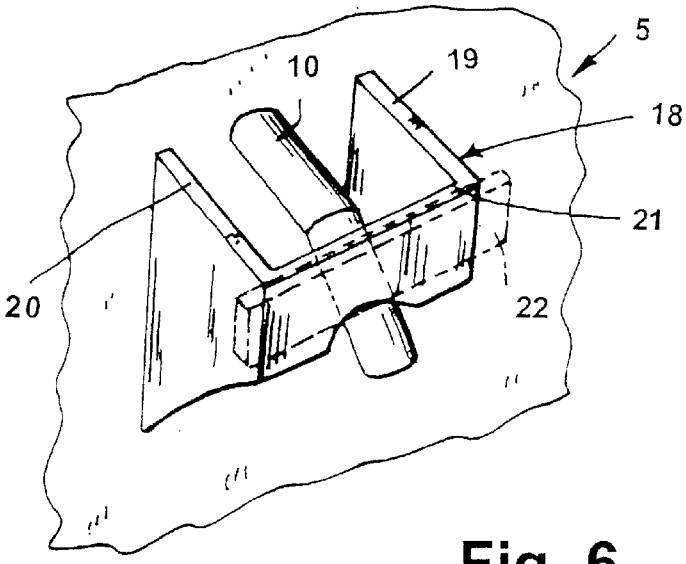
FIG. 6 is a partial perspective view of a detail of the dispenser.

In one embodiment of the invention, the base 5 presents a seat 16 in which a lever microswitch 17 is mounted to control the solenoid valve 14 (and the possible pump 15). The base also presents a projecting support 18 (FIGS. 3 and 6) provided with two side walls 19, 20 and an interconnecting crosspiece 21 to which there is fixed in any known manner a plate 22 (for example of a printed circuit) with which pushbuttons or the like 23 are associated, sealedly projecting to the outside of the component 9. These pushbuttons can be used to prevent the use of the dispenser by a child (for example to prevent the valve 14 from being opened), to enable a gas (CO2) to be added to the refrigerated water (by connecting a relative vessel with valve to the hydraulic system of FIG. 3), or to modify the water flow rate and hence its temperature (for example by not only allowing the valve 14 to be opened and closed by the action of the microswitch 17 but also be varied in its extent of opening by a command imparted by said pushbuttons). In a variant the printed circuit can be positioned on the top of the projecting support 18 as shown by dashed and dotted lines in FIG. 3 in which it is indicated by 22', the pushbuttons 23 then being positioned in relation thereto. The microswitch 17 can also be mounted on the support 18.

The aforesaid component 9 is of shell shape, this term being used hereinafter for its identification. It is preferably constructed of plastic material and is snap-fitted to the base 5, for which purpose projections or recesses 24 are provided on its periphery, to cooperate with recesses or projections 8 provided on the base 5 (see the alternatives of FIGS. 3 and 4). This snap-fitting enables the shell 9 to be removed for maintenance and/or cleaning purposes. It can be understood, therefore, that the base and the shell combine to form a compartment or enclosure for surrounding the water delivery port. The base and shell could be formed as a single integral member.

As the face or outer wall 3*a* of the refrigerator door 3 may be arched, the periphery of the base 5, or the relative surrounding wall 7, 7', is provided with said flexible flange or end 25 which when fitted against the wall 3*a* conceals from view (and also acts as a seal gasket) the discontinuity or gap present between the (substantially flat) base and the (arched) wall 3*a* of the door 3.

The shell 9 presents frontally an aperture 26 of judiciously chosen shape and dimensions, intercepted by a cover 27.

Figure 2:
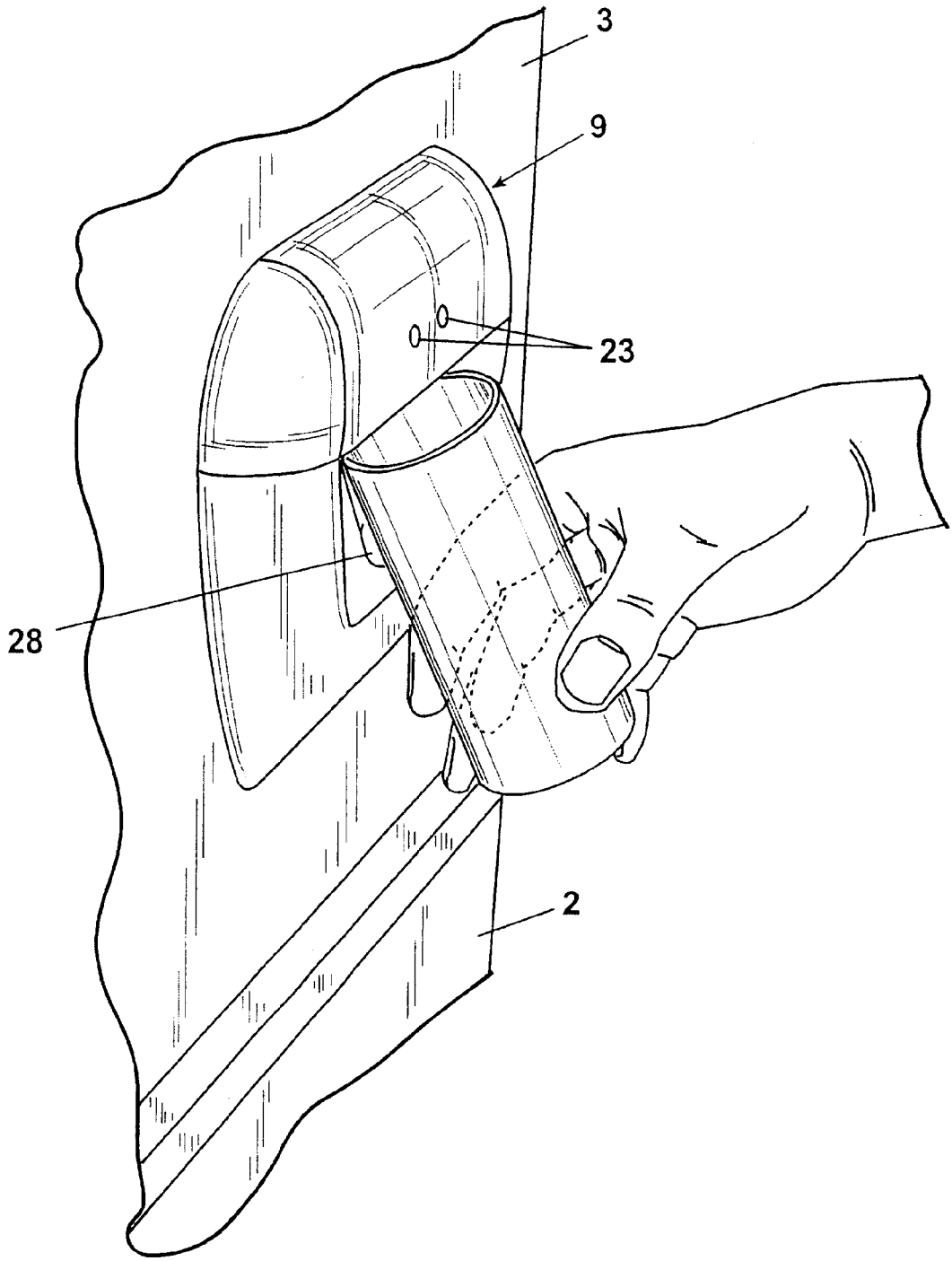
FIG. 2 is a perspective view of the dispenser at the moment of use.

The cover 27 has a central recess 28 (the function of which is stated hereinafter with reference to FIG. 2). In one embodiment the cover 27 has on its inner side, integral therewith, an elastic profiled arm 29 dimensioned such as to bear against the base 5 and urge the cover 27 into a position in which it closes the aperture 26 in the shell 9.

In its lower part, the cover 27 defines a small closed compartment 30 acting as a droplet collector. In a variant of the invention, the arm 29 is formed by the actual rear wall of the cover 27, which hence comprises side walls, the upper profile of which is represented by the dashed and dotted line indicated by A in FIG. 3. The flexibility of the chosen material provides the closure thrust for the cover 27.

Figure 5:
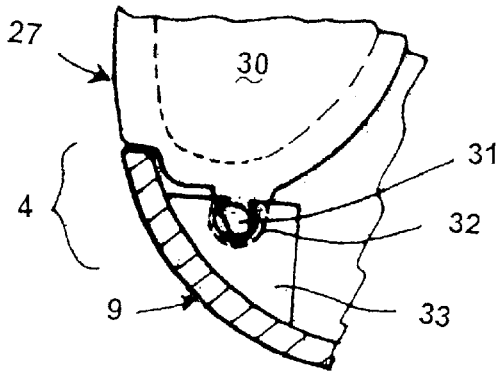
FIG. 5 is a sectional detail relative to the hinging between two parts of the dispenser.

The cover 27 is hinged at its lower end (see FIGS. 3 and 5) to the shell 9. This hinging comprises a pair of slightly flattened axially aligned pins 31 (see FIG. 5) projecting from opposite sides of the cover 27 and inserted into respective narrow-mouth seats 32 present in parallel ribs 33 situated on the inner side of the shell 9.

When water is required (FIG. 2), the user rests the glass against the cover 27 utilizing, for correct support, the recess 28 therein which facilitates its centering; he then presses against the cover, which then rotates inwards, about the hinge 31, 32, against the reaction of the elastic arm 29 or (in the case of the variant) of the rear wall of the cover 27. After a certain extent of rotation, when the mouth of the glass lies below the port 10, the microswitch 17 is operated (by the arm 29 or by another part of the cover 27), to open the valve 14 with resultant delivery of the refrigerated water. When filled to the required extent, the user withdraws the glass from the cover 27. The cover moves towards its closure position under the thrust of the elastic arm 29 and the microswitch 17 interrupts delivery.

The applicant claims as their invention all combinations covered by the appended claims. The claimed invention is not intended to be limited to only the exact embodiment shown in the drawings and detailed description. Rather, it is intended that the claims shall cover all minor and obvious modifications and applications that do not depart from the spirit and scope of the present invention. For example, there are many ways in which the cover may mount to the shell and the invention is not meant to be limited to the particular configuration disclosed in the drawing and description. Further, it can be readily appreciated that parts—such as the base and the shell—may be formed as a single part through advance plastic part molding techniques. Other modifications and applications will occur to those skilled in the art.

We claim:

1. In a refrigerator having a door which includes a water delivery port, the improvement comprising:

a water dispenser structure forming a compartment wherein the water delivery port is situated within the compartment and wherein the water dispenser is mounted on the outside of the door, said dispenser structure further comprising:

a shell;

an elastically loaded cover supported by the shell and arranged to close within the shell;

an aperture giving access to the compartment, and a base for connection to the door.

2. The improvement to a refrigerator according to claim 1, wherein the cover is hinged to the shell.

3. The improvement to a refrigerator according to claim 1, further comprising: an electrical contact member supported by the base and operated by the cover.

4. The improvement to a refrigerator according to claim 3, wherein the electrical contact member is operated by the cover via an arm thereof.

5. The improvement to a refrigerator according to claim 4, wherein the arm elastically urges the cover into the position in which it closes the aperture, and bears against the base.

6. The improvement to a refrigerator according to claim 4 wherein the arm is an elastic member which is formed integrally with the cover.

7. The improvement to a refrigerator according to claim 1, wherein the base carries the delivery port.

8. The improvement to a refrigerator according to claim 1, wherein the cover presents a positioning recess.

9. The improvement to a refrigerator according to claim 1, wherein the base presents support means for control circuit parts.

10. The improvement to a refrigerator according to claim 1, wherein the shell is snap-fitted to the base, in such a manner as to be removable.

11. The improvement to a refrigerator according to claim 1, wherein the cover defines a droplet collection compartment.

12. The improvement to a refrigerator according to claim 1, wherein the cover presents lateral walls (A) connected to a rear wall which bears elastically against the base.

13. The dispenser for a refrigerator according to claim 1, further comprising:

an elastic arm for biasing the cover into contact with the base wherein the electrical contact member is operated by the arm.

14. The dispenser for a refrigerator according to claim 13, herein the arm elastically urges the cover into the position in which it closes the aperture, and bears against the base.

15. A dispenser for a refrigerator having a door which includes a water delivery port, the dispenser comprising:

a base mounted on the door for forming a compartment exterior of the door enclosing the water delivery port, the base including an aperture for accessing the interior of the compartment and the water delivery port; and a cover pivotably supported by the base and biased for closing the aperature, the cover being supported to pivot inwardly into the compartment for accessing the water delivery port.

16. The dispenser for a refrigerator according to claim 15, further comprising:

a shell mounted to the base for forming the compartment, the shell extending outwardly from the base and defining the aperature, the cover being hinged to the shell.

17. The dispenser for a refrigerator according to claim 15, further comprising:

an electrical contact member supported by the base and operated by the cover.

18. A dispenser for a refrigerator door having an outer wall through which a water delivery port extends, the dispenser comprising:

a base mounted to the outer wall of the door;

a shell mounted to the base and extending outwardly from the base, the shell and base forming a compartment enclosing the water delivery port wherein the shell has an aperture for accessing the interior of the compartment; and a cover pivotably supported by the shell and biased for closing the aperature, the cover being supported to pivot inwardly into the compartment for accessing the water delivery port.

* * * * *